US007838186B2

(12) United States Patent
Wu et al.

(10) Patent No.: US 7,838,186 B2
(45) **Date of Patent: *Nov. 23, 2010**

(54) PHOTOCONDUCTORS CONTAINING CHARGE TRANSPORT CHELATING COMPONENTS

(75) Inventors: Jin Wu, Webster, NY (US); Kent J Evans, Lima, NY (US); Sherri A. Colon, Webster, NY (US); Dale S. Renfer, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 815 days.

This patent is subject to a terminal disclaimer.

(21) Appl. No.: 11/804,480

(22) Filed: May 18, 2007

(65) Prior Publication Data

US 2008/0286670 A1 Nov. 20, 2008

(51) Int. Cl.
*G03G 5/00* (2006.01)

(52) U.S. Cl. ..... 430/58.05; 430/58.25; 430/58.65; 430/58.75; 430/58.8

(58) Field of Classification Search ..... 430/58.05, 430/58.25, 58.65, 58.75, 58.8
See application file for complete search history.

(56) References Cited

U.S. PATENT DOCUMENTS 4,160,667 A * 7/1979 Halm ..... 430/81
4,251,615 A * 2/1981 Rosenthal ..... 430/89
4,265,990 A 5/1981 Stolka et al.
5,449,573 A * 9/1995 Aoki et al. ..... 430/131
5,473,064 A 12/1995 Mayo et al.
5,482,811 A 1/1996 Keoshkerian et al.
5,521,306 A 5/1996 Burt et al.
7,678,517 B2 * 3/2010 Lin et al. ..... 430/59.4
2004/0197690 A1 * 10/2004 Yamada et al. ..... 430/96

OTHER PUBLICATIONS

Jin Wu et al., U.S. Appl. No. 11/714,599 on Photoconductors Containing Chelating Components, filed Mar. 6, 2007.
Jin Wu et al., U.S. Appl. No. 11/714,613 on Photoconductors Containing Photogenerating Chelating Components, filed Mar. 6, 2007.
Jin Wu et al., U.S. Appl. No. 11/593,658 on Photoconductors Containing Chelating Components, filed Nov. 7, 2006.
John F. Yanus et al., U.S. Appl. No. 11/593,657 on Overcoated Photoconductors with Thiophosphate Containing Charge Transport Layers, filed Nov. 7, 2006.
John F. Yanus et al., U.S. Appl. No. 11/593,662 on Overcoated Photoconductors with Thiophosphate Containing Photogenerating Layer, filed Nov. 7, 2006.

* cited by examiner

*Primary Examiner*—Mark A Chapman
(74) *Attorney, Agent, or Firm*—Oliff & Berridge, PLC

(57) ABSTRACT

A photoconductor that includes an optional supporting substrate, a photogenerating layer, and at least one charge transport layer, and wherein the charge transport layer contains a phenolic chelating additive.

29 Claims, No Drawings

PHOTOCONDUCTORS CONTAINING CHARGE TRANSPORT CHELATING COMPONENTS

CROSS REFERENCE TO RELATED APPLICATIONS

U.S. application Ser. No. 11/714,599, now U.S. Pat. No. 7,618,756, filed Mar. 6, 2007 on Photoconductors Containing Chelating Components by Jin Wu et al., and more specifically, a photoconductor comprised of an optional supporting substrate, a photogenerating layer, and at least one charge transport layer, and wherein said photogenerating layer contains a chelating additive.

U.S. application Ser. No. 11/714,613, now U.S. Pat. No. 7,718,336, filed Mar. 6, 2007 on Photoconductors Containing Photogenerating Chelating Components by Jin Wu et al., and more specifically, a photoconductor comprised of an optional supporting substrate, a photogenerating layer, and at least one charge transport layer, and wherein said photogenerating layer contains a chelating additive of at least one of a β-diketone, a ketoester, a hydroxyl carboxylic acid, a hydroxyl carboxylic acid ester, a keto alcohol, and an amino alcohol.

A number of the components of the above cross referenced patent applications, such as the supporting substrates, the photogenerating layer pigments and binders, the charge transport layer molecules and binders, the adhesive layer materials, and the like may be selected for the photoconductors of the present disclosure in embodiments thereof.

BACKGROUND

This disclosure is generally directed to imaging members, photoreceptors, photoconductors, and the like. More specifically, the present disclosure is directed to rigid or multilayered flexible, belt imaging members, or devices comprised of an optional supporting medium like a substrate, an optional undercoat or hole blocking layer usually situated between the substrate and the photogenerating layer, and at least one chelating containing charge transport layer, wherein at least one is from 1 to about 5, from 1 to about 3, 2, one, and the like, such as a first charge transport layer and a second charge transport layer, an optional adhesive layer, and an optional overcoating layer, and wherein at least one of the charge transport layers contains in addition to the chelating agent at least one charge transport component, and a polymer or resin binder, and where in embodiments the resin binder selected for the undercoat layer is a known suitable binder including a binder that is substantially insoluble in a number of solvents like methylene chloride, examples of these binders being illustrated in copending U.S. application Ser. No. 11/593,658, filed Nov. 7, 2006 on Photoconductors Containing Halogenated Binders by Jin Wu et al., the disclosure of which is totally incorporated herein by reference. In embodiments, there is disclosed a photoconductor where the charge transport layer contains a chelating agent which for example, passivates the conductive carbon residue that is intrinsically associated with the charge transport component, such as the hole transport molecules or compounds in the charge transport layer thereby resulting in a reduction in the CDS counts. The conductive carbon residue is believed to primarily result from the processes used to prepare charge transport components, such as aryl amine molecules.

In embodiments there are disclosed low charge deficient spots (CDS) photoconductors where the charge transport layer is comprised of at least one charge transport, a polymeric binder and a chelating agent. Also, when present the hole blocking layer can contain in embodiments phenol resins, known hole blocking layer polymers as illustrated in U.S. Pat. No. 6,913,863, the disclosure of which is totally incorporated herein by reference, which discloses a hole blocking layer, a photogenerating layer, and a charge transport layer, and wherein the hole blocking layer is comprised of a metal oxide, and a mixture of a phenolic compound and a phenolic resin wherein the phenolic compound contains at least two phenolic groups, or chlorinated polymeric resins as the binder and a hydrolyzed aminosilane as the electroconducting species since it is believed that the $CH_2Cl_2$ insoluble binders prevent or minimize the migration of hole transport molecules from an upper charge transport layer into lower layers, and then into the undercoat or ground plane layer. Examples of chlorinated homopolymers include polyvinylidene chloride, chlorinated polyvinyl chloride and chlorinated polyvinylidene chloride. Examples of chlorinated copolymers include copolymers of vinylidene chloride, chlorinated vinyl chloride, and chlorinated vinylidene chloride with vinylidene fluoride, tetrafluoroethylene, trifluorochloroethylene, hexafluoropropylene, and the like.

A number of advantages are associated with the disclosed photoconductors, such as for example the formation of minimal charge deficient spots (CDS) which result in undesirable printing defects and where the spots can be generated from the charge transport layer or layers; minimization or prevention of the migration of hole transport molecules or components from one charge transport layer to another layer in the photoconductor, such as the photogenerating layer and the charge transport layer, and more specifically, from the top or upper charge transport layer into lower layers of the photoconductor, such as lower charge transport layers and the lower photogenerating layer thereby permitting less undesirable charge deficient spots in the developed image generated. The photoreceptors illustrated herein, in embodiments, have extended lifetimes; possess excellent, and in a number of instances low $V_r$ (residual potential); and allow the substantial prevention of $V_r$ cycle up when appropriate; high sensitivity; low acceptable image ghosting characteristics; and desirable toner cleanability.

Also included within the scope of the present disclosure are methods of imaging and printing with the photoconductors illustrated herein. These methods generally involve the formation of an electrostatic latent image on the imaging member, followed by developing the image with a toner composition comprised, for example, of thermoplastic resin, colorant, such as pigment, charge additive, and surface additive, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the photoconductor is to be used in a printing mode, the imaging method involves the same operation with the exception that exposure can be accomplished with a laser device or image bar. More specifically, the flexible photoconductor belts disclosed herein can be selected for the Xerox Corporation iGEN® machines that generate with some versions over 100 copies per minute. Processes of imaging, especially xerographic imaging and printing, including digital, and/or color printing, are thus encompassed by the present disclosure.

REFERENCES

Layered photoconductors have been described in a number of U.S. patents, such as U.S. Pat. No. 4,265,990, the disclosure of which is totally incorporated herein by reference, wherein there is illustrated an imaging member comprised of a photogenerating layer, and an aryl amine hole transport layer, and which layers can include a number of resin binders. Examples of photogenerating layer components disclosed in the '990 patent include trigonal selenium, metal phthalocyanines, vanadyl phthalocyanines, and metal free phthalocyanines. Additionally, there is described in U.S. Pat. No. 3,121,006, the disclosure of which is totally incorporated herein by reference, a composite xerographic photoconductive member comprised of finely divided particles of a photoconductive inorganic compound and an amine hole transport dispersed in an electrically insulating organic resin binder.

Further, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with, for example, a perylene, pigment photogenerating component. Both of the aforementioned patents disclose an aryl amine component, such as N,N'-diphenyl-N,N'-bis(3-methylphenyl)-1,1'-biphenyl-4,4'-diamine dispersed in a polycarbonate binder as a hole transport layer.

In U.S. Pat. No. 4,921,769, the disclosure of which is totally incorporated herein by reference, there are illustrated photoconductive imaging members with blocking layers of certain polyurethanes.

Illustrated in U.S. Pat. No. 5,521,306, the disclosure of which is totally incorporated herein by reference, is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811, the disclosure of which is totally incorporated herein by reference, is a process for the preparation of hydroxygallium phthalocyanine photogenerating pigments, which comprises hydrolyzing a gallium phthalocyanine precursor pigment by dissolving the hydroxygallium phthalocyanine in a strong acid, and then reprecipitating the resulting dissolved pigment in basic aqueous media; removing any ionic species formed by washing with water, concentrating the resulting aqueous slurry comprised of water and hydroxygallium phthalocyanine to a wet cake; removing water from said slurry by azeotropic distillation with an organic solvent, and subjecting said resulting pigment slurry to mixing with the addition of a second solvent to cause the formation of said hydroxygallium phthalocyanine polymorphs.

Also, in U.S. Pat. No. 5,473,064, the disclosure of which is totally incorporated herein by reference, there is illustrated a process for the preparation of photogenerating pigments of hydroxygallium phthalocyanine Type V essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and preferably about 19 parts with 1,3-diiminoisoindolene ($DI^3$) in an amount of from about 1 part to about 10 parts, and preferably about 4 parts of $DI^3$, for each part of gallium chloride that is reacted; hydrolyzing said pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts, and preferably about 15 volume parts for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

The appropriate components, and processes of the above-recited patents may be selected for the present disclosure in embodiments thereof. More specifically, a number of the components and amounts thereof of the above patents, such as the supporting substrates, resin binders for the charge transport layer, photogenerating layer components like hydroxygallium phthalocyanines (OHGaPc), antioxidants, charge transport components, hole blocking layer components, adhesive layer components, and the like, may be selected for the photoconductors of the present disclosure in embodiments thereof.

SUMMARY

Disclosed are imaging members with many of the advantages illustrated herein, such as the minimal generation of charge deficient spots, extended lifetimes of service of, for example, about 2,000,000 imaging cycles; excellent electronic characteristics; stable electrical properties; low image ghosting; resistance to charge transport layer cracking upon exposure to the vapor of certain solvents; consistent $V_r$ (residual potential) that is substantially flat or no change over a number of imaging cycles as illustrated by the generation of known PIDC (Photo-Induced Discharge Curve), and the like.

Further disclosed are layered flexible photoresponsive imaging members with sensitivity to visible light.

Moreover, disclosed are layered belt photoresponsive or photoconductive imaging members with mechanically robust and solvent resistant charge transport layers.

EMBODIMENTS

Aspects of the present disclosure relate to an imaging member comprising an optional supporting substrate, a photogenerating layer comprised of a photogenerating component optionally dispersed in a resin or polymer, and at least one charge transport layer, such as from one to about 7 layers, from 1 to about 5 layers, from 1 to about 3 layers, 2 layers, or 1 layer, and where the charge transport layer component impurities, such as conductive carbon residues, are captured by and complexed with a chelating agent, that is for example, where the chelating agent bonds to the impurities to thereby suppress the formation of undesirable charge deficient spots; a flexible photoconductor comprising in sequence a substrate, a photogenerating layer, and a chelating agent containing a charge transport layer comprised of at least one charge transport component comprised of hole transport molecules and a resin binder, and an optional hole blocking layer comprised, for example, of an aminosilane and a halogenated, such as a chlorinated, polymeric resin that is insoluble or substantially insoluble in methylene chloride, and a number of other similar solvents; a photoconductive member with a photogenerating layer of a thickness of from about 0.1 to about 10 microns, at least one transport layer each of a thickness of from about 1 to about 100 microns; an imaging method and an imaging apparatus containing a charging component, a development component, a transfer component, and a fixing component, and wherein the apparatus contains a photoconductive imaging member comprised of a supporting substrate, a photogenerating layer comprised of a photogenerating pigment prepared from a dispersion of the pigment and a binder polymer, and a chelating agent containing charge transport layer or layers, and thereover an overcoating charge transport layer, and where the transport layer is of a thickness of from about 10 to about 75 microns; a member wherein the photogenerating layer contains a binder, like a polycarbonate, and dispersed therein a photogenerating pigment present in an amount of from about 35 to about 99 weight percent; a member wherein the thickness of the photogenerating layer is from about 0.1 to about 4 microns; a member wherein hole a blocking layer polymer binder is present in an amount of from about 0.1 to about 90, from 1 to about 50, from 2 to about 25, from 5 to about 10 percent by weight, and wherein the total of all blocking layer components is about 100 percent; a member wherein the photogenerating component is a hydroxygallium phthalocyanine that absorbs light of a wavelength of from about 370 to about 950 nanometers, and a charge transport layer substantially free of impurities that adversely impact the charge transport layer components, and where charge deficient spots (CDS) are substantially avoided; an imaging member or photoconductor wherein the supporting substrate is comprised of a conductive substrate comprised of a metal; an imaging member wherein the conductive substrate is aluminum, aluminized polyethylene terephthalate, or titanized polyethylene terephthalate; an imaging member wherein each of the charge transport layers comprises

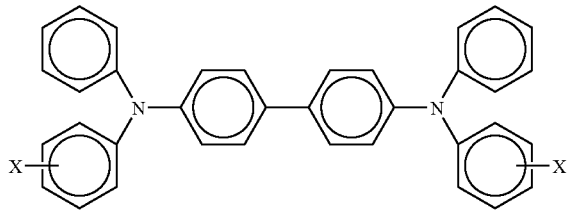

wherein X is selected from the group consisting of a suitable hydrocarbon like alkyl, alkoxy, aryl, and substituted derivatives thereof; halogen, and mixtures thereof, or wherein X can be included on the four terminating rings; an imaging member wherein alkyl and alkoxy contains from about 1 to about 12 carbon atoms; an imaging member wherein alkyl contains from about 1 to about 5 carbon atoms; an imaging member wherein alkyl is methyl; an imaging member wherein each of or at least one of the charge transport layers comprises

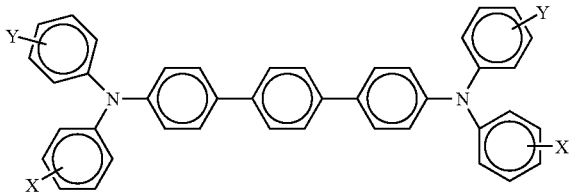

wherein X and Y are independently alkyl, alkoxy, aryl, a halogen, or mixtures thereof; an imaging member wherein for the above terphenyl amine alkyl and alkoxy each contains from about 1 to about 12 carbon atoms; an imaging member wherein alkyl contains from about 1 to about 5 carbon atoms; an imaging member wherein the photogenerating pigment present in the photogenerating layer is comprised of chlorogallium phthalocyanine, titanyl phthalocyanine, or Type V hydroxygallium phthalocyanine prepared, for example, by hydrolyzing a gallium phthalocyanine precursor by dissolving the hydroxygallium phthalocyanine in a strong acid, and then reprecipitating the resulting dissolved precursor in a basic aqueous media; removing any ionic species formed by washing with water; concentrating the resulting aqueous slurry comprised of water and hydroxygallium phthalocyanine to a wet cake; removing water from the wet cake by drying; and subjecting the resulting dry pigment to mixing with the addition of a second solvent to cause the formation of the hydroxygallium phthalocyanine; an imaging member wherein the Type V hydroxygallium phthalocyanine has major peaks, as measured with an X-ray diffractometer, at Bragg angles (2Θ+/−0.2°) 7.4, 9.8, 12.4, 16.2, 17.6, 18.4, 21.9, 23.9, 25.0, 28.1 degrees, and the highest peak at 7.4 degrees; a method of imaging which comprises generating an electrostatic latent image on an imaging member, developing the latent image, and transferring the developed electrostatic image to a suitable substrate; a method of imaging wherein the imaging member is exposed to light of a wavelength of from about 370 to about 950 nanometers; a member wherein the photogenerating layer is situated between the substrate and the charge transport layer or layers; a member wherein the charge transport layer is situated between the substrate and the photogenerating layer; a member wherein the photogenerating layer is of a thickness of from about 0.1 to about 50 microns; a member wherein the photogenerating component amount is from about 0.05 weight percent to about 95 weight percent, and wherein the photogenerating pigment is dispersed in from about 96 weight percent to about 5 weight percent of polymer binder, and where the hole blocking layer contains a chlorinated polymer binder; a member wherein the thickness of the photogenerating layer is from about 0.2 to about 12 microns; an imaging member wherein the charge transport layer resinous binder is selected from the group consisting of polyesters, polyvinyl butyrals, polycarbonates, polyarylates, copolymers of polycarbonates and polysiloxanes, polystyrene-b-polyvinyl pyridine, and polyvinyl formals; an imaging member wherein the photogenerating component is a hydroxygallium phthalocyanine, a titanyl phthalocyanine or a halogallium phthalocyanine, and the charge transport layer contains a hole transport of N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, or N,N'-diphenyl-N,N'-bis(3-chlorophenyl)-[p-terphenyl]-4,4"-diamine molecules; an imaging member wherein the photogenerating layer contains an alkoxygallium phthalocyanine; a photoconductive imaging member with an aminosilane and chlorinated polymer containing blocking layer contained as a coating on a substrate, and an adhesive layer coated on the blocking layer; a color method of imaging which comprises generating an electrostatic latent image on the imaging member, developing the latent image, transferring, and fixing the developed electrostatic image to a suitable substrate; photoconductive imaging members comprised of a supporting substrate, a hole blocking or undercoat layer as illustrated herein, a photogenerating layer, a hole transport layer, and a top overcoating layer in contact with the hole transport layer, or in embodiments, in contact with the photogenerating layer, and in embodiments wherein a plurality of charge transport layers are selected, such as for example, from 2 to about 10, and more specifically, 2 to about 4 may be selected; and a photoconductive imaging member comprised in sequence of a supporting substrate, a hole blocking layer; a photogenerating layer comprised of a photogenerating pigment and a first, second, or third charge transport layer, and where the impurities therein are bonded and captured by a chelating agent; a photoconductor comprising in sequence a substrate, a hole blocking or undercoat layer, a photogenerating pigment layer, and a charge transport layer comprised of at least one charge transport component, a resin binder, and a chelating additive, which includes conductive carbon bonded to the chelating agent thereby minimizing undesirable charge deficient spots; and a photoconductor comprising a supporting substrate, a photogenerating layer, and at least one charge transport layer, and wherein the charge transport layer contains a chelating additive containing at least one of the following moieties

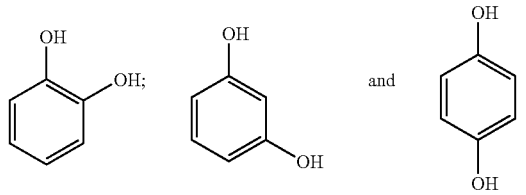

or wherein the chelating additive is comprised of two or three phenolic groups present on one benzene ring, and with a weight average molecular weight of, for example, from about 100 to about 2,000, from about 475 to about 1,000, and more specifically, from about 105 to about 500; a photoconductor wherein the charge transport layer is comprised of at least one of aryl amine molecules of the formulas

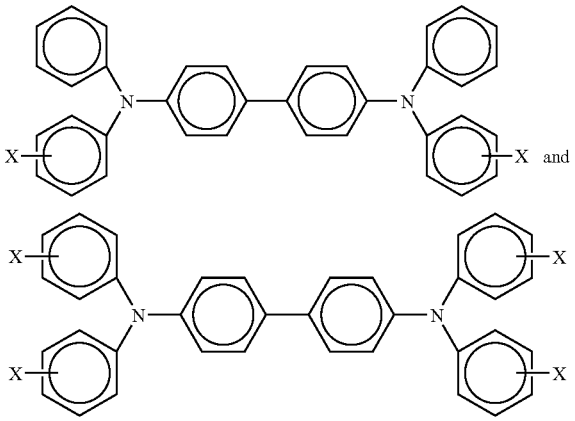

wherein X is selected from the group consisting of at least one of alkyl, alkoxy, aryl, and halogen, and mixtures thereof; a photoconductor wherein the charge transport layer is comprised of at least one of

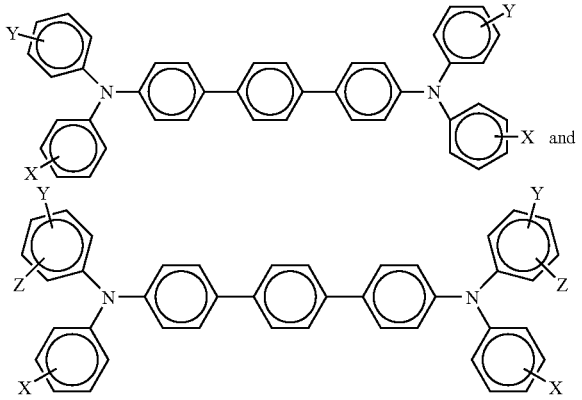

wherein each X and Y is independently selected from the group consisting of alkyl, alkoxy, aryl, halogen; and mixtures thereof; and wherein X, Y and Z are alkyl, alkoxy, aryl, substituted derivatives thereof, halogen, and mixtures thereof.

A number of suitable chelating agents can be selected in various effective amounts, such as for example, from about 0.001 to about 30, from about 0.1 to about 20, from about 1 to about 10, from about 0.5 to about 5, from about 0.5 to about 4, or from about 0.5 to about 10 weight percent based on the total amount of the components in the charge transport layer or layers. Examples of chelating agents include agents or additives that contain at least one of the following

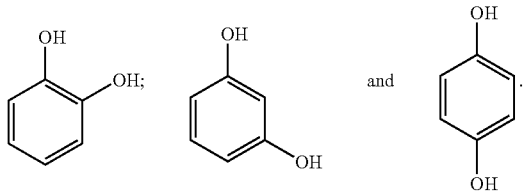

Specific examples of chelating agents are pyrocatechol (catechol), 1,3-benzenediol, 1,4-benzenediol, 4-methylcatechol, 3-methylcatechol, 1,2,4-benzenetriol, pyrogallol, 3-fluorocatechol, 3,4-dihydroxybenzonitrile, 2,3-dihydroxybenzaldehyde, 3,4-dihydroxybenzaldehyde, 3-methoxycatechol, 5-methyl-1,2,3-benzenetriol, 2-methoxy-1,4-benzenediol, 4-chloro-1,2-benzenediol, 1-(3,4-dihydroxyphenyl)ethanone, 2,4,5-trihydroxybenzaldehyde, 2,3,4-trihydroxybenzaldehyde, 3,4-dihydroxybenzoic acid, 2,3-dihydroxybenzoic acid, 3,4,5-trihydroxybenzaldehyde, 4-nitro-1,2-benzenediol, 1,2-naphthalenediol, 2,3-naphthalenediol, 4-tert-butyl-1,2-benzenediol, 3-isopropyl-6-methyl-1,2-benzenediol, methyl 3,4-dihydroxybenzoate, (3,4-dihydroxyphenyl)acetic acid, 4,5-dihydroxy-2-methylbenzoic acid, 3,4,5-trihydroxybenzamide, 4-(2-amino-1-hydroxyethyl)-1,2-benzenediol, 2,4,5-trihydroxybenzoic acid, 2,3,4-trihydroxybenzoic acid, 2,6-dimethoxy-1,4-benzenediol, 4-(1,2-dihydroxyethyl)-1,2-benzenediol, 7,8-dihydroxy-2H-chromen-2-one, 6,7-dihydroxy-2H-chromen-2-one, 3,5-dichloro-1,2-benzenediol, 2-methyl-1,3-benzothiazole-5,6-diol, 4-(2-aminoethyl)-1,2-benzenediol hydrochloride, 7,8-dihydroxy-4-methyl-2H-chromen-2-one, 3-tert-butyl-5-methoxy-1,2-benzenediol, 3,5-dinitro-1,2-benzenediol, 2-(3,4,5-trihydroxybenzylidene)malononitrile, 4-[2-(methylamino) ethyl]-1,2-benzenediol hydrochloride, 5-(2-aminoethyl)-1,2,4-benzenetriol hydrochloride, 5-(2-aminoethyl)-1,2,3-benzenetriol hydrochloride, 7,8-dihydroxy-6-methoxy-2H-chromen-2-one, 2,3,4,6-tetrahydroxy-5H-benzo[a] cyclohepten-5-one, 1,2,10-anthracenetriol, 3,4-dihydroxy-7,8,9,10-tetrahydro-6H-benzo[c]chromen-6-one, 4-{(E)-[(3,5-dimethyl-4H-1,2,4-triazol-4-yl)imino]methyl}-1,2-benzenediol, 4-{[(E)-(2,3-dihydroxyphenyl)methylidene] amino}benzonitrile, 1,2-dihydroxyanthra-9,10-quinone, 4-[(E)-2-(3,5-dihydroxyphenyl)ethenyl]-1,2-benzenediol, 6-[(E)-2-(3,4-dihydroxyphenyl)ethenyl]-4-hydroxy-2H-pyran-2-one, 3,4,5,6-tetrachloro-1,2-benzenediol, 5-(2-aminoethyl)-1,2,4-benzenetriol hydrobromide, 7,8-dihydroxy-2-phenyl-4H-chromen-4-one, 1,2,7-trihydroxyanthra-9,10-quinone, 1,2,4-trihydroxyanthra-9,10-quinone, 2,6,7-trihydroxy-9-methyl-3H-xanthen-3-one, and the like, including, for example, various suitable derivatives, halogen, alkyl, and alkoxy of these specifically disclosed chelating agents; dihydroxyaryl chelating agents; and also other similar known compounds, and mixtures thereof.

The thickness of the photoconductor substrate layer depends on a number of factors, including economical considerations, electrical characteristics, and the like, thus this layer may be of a thickness, for example over 3,000 microns, such as from about 1,000 to about 3,000 microns, from about 1,000 to 2,000 microns, from about 500 to about 1,200 microns, or from about 300 to about 700 microns, or of a minimum thickness, such as from about 50 to about 400 microns. In embodiments, the thickness of this layer is from about 75 microns to about 300 microns, or from about 100 to about 150 microns.

The substrate may be opaque or substantially transparent, and may comprise any suitable material that functions as a supporting layer for the hole blocking, adhesive, photogenerating, and charge transport layers, and which substrate should possess the appropriate mechanical properties. Accordingly, the substrate may comprise a layer of an electrically nonconductive or conductive material, such as an inorganic or an organic composition. As electrically nonconducting materials, there may be employed various resins known for this purpose including polyesters, polycarbonates, polyamides, polyurethanes, and the like, which are flexible as thin webs. An electrically conducting substrate may be any suitable metal of, for example, aluminum, nickel, steel, copper, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors, including strength desired and economical considerations. For a drum photoconductor, this layer may be of substantial thickness of, for example, up to many centimeters or of a minimum thickness of less than a millimeter. Similarly, a flexible belt may be of a substantial thickness of, for example, about 250 micrometers, or of a minimum thickness of equal to or less than about 50 micrometers, such as from about 5 to about 45, from about 10 to about 40, from about 1 to about 25, or from about 3 to about 45 micrometers. In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

Illustrative examples of substrates are as illustrated herein, and more specifically, layers selected for the imaging members of the present disclosure, and which substrates can be opaque or substantially transparent, comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

The photogenerating layer in embodiments is comprised of, for example, about 60 weight percent of Type V hydroxygallium phthalocyanine or chlorogallium phthalocyanine, and about 40 weight percent of a resin binder. Generally, the photogenerating layer can contain known photogenerating pigments, such as metal phthalocyanines, metal free phthalocyanines, alkylhydroxyl gallium phthalocyanines, hydroxygallium phthalocyanines, chlorogallium phthalocyanines, perylenes, especially bis(benzimidazo)perylene, titanyl phthalocyanines, and the like, and more specifically, vanadyl phthalocyanines, Type V hydroxygallium phthalocyanines, and inorganic components such as selenium, selenium alloys, and trigonal selenium. Generally, the thickness of the photogenerating layer depends on a number of factors, including the thicknesses of the other layers, and the amount of photogenerating material contained in the photogenerating layer. Accordingly, this layer can be of a thickness of, for example, from about 0.05 micron to about 10 microns, and more specifically, from about 0.25 micron to about 4 microns when, for example, the photogenerating compositions are present in an amount of from about 30 to about 75 percent by volume. The maximum thickness of this layer in embodiments is dependent primarily upon factors, such as photosensitivity, electrical properties, and mechanical considerations.

Photogenerating layer examples may comprise amorphous films of selenium and alloys of selenium and arsenic, tellurium, germanium and the like, hydrogenated amorphous silicon and compounds of silicon and germanium, carbon, oxygen, nitrogen, and the like fabricated by vacuum evaporation or deposition. The photogenerating layers may also comprise inorganic pigments of crystalline selenium and its alloys; Group II to VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos; and the like dispersed in a film forming polymeric binder, and fabricated by solvent coating techniques.

Various suitable and conventional known processes may be used to mix, and thereafter apply the photogenerating layer coating like spraying, dip coating, roll coating, wire wound rod coating, vacuum sublimation, and the like. For some applications, the photogenerating layer may be fabricated in a dot or line pattern. Removal of the solvent of a solvent-coated layer may be effected by any known conventional techniques such as oven drying, infrared radiation drying, air drying, and the like.

The coating of the photogenerating layer in embodiments of the present disclosure can be accomplished such that the final dry thickness of the photogenerating layer is as illustrated herein, and can be, for example, from about 0.01 to about 30 microns after being dried at, for example, about 40° C. to about 150° C. for about 1 to about 90 minutes. More specifically, a photogenerating layer of a thickness, for example, of from about 0.1 to about 30, or from about 0.2 to about 5 microns can be applied to or deposited on the substrate, on other surfaces in between the substrate and the charge transport layer, and the like.

For the deposition of the photogenerating layer, it is desirable to select a coating solvent that may not substantially disturb or adversely affect the other previously coated layers of the device. Examples of coating solvents for the photogenerating layer are ketones, alcohols, aromatic hydrocarbons, halogenated aliphatic hydrocarbons, ethers, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

In embodiments, a suitable known adhesive layer can be included in the photoconductor. Typical adhesive layer materials include, for example, polyesters, polyurethanes, and the like. The adhesive layer thickness can vary and in embodiments is, for example, from about 0.05 micrometer (500 Angstroms) to about 0.3 micrometer (3,000 Angstroms). The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying, and the like.

As optional adhesive layers usually in contact with or situated between the hole blocking layer and the photogenerating layer, there can be selected various known substances inclusive of copolyesters, polyamides, poly(vinyl butyral), poly (vinyl alcohol), polyurethane and polyacrylonitrile. This layer is, for example, of a thickness of from about 0.001 micron to about 1 micron, or from about 0.1 to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure further desirable electrical and optical properties.

A number of suitable known charge transport components, molecules, or compounds can be selected for the charge transport layer, which layer is generally of a thickness of from about 2 microns to about 90 microns, and more specifically, of a thickness of from about 10 microns to about 40 microns, such as aryl amines of the following formula/structure

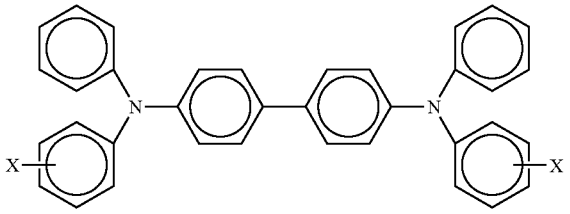

wherein X, which X may also be contained on each of the four terminating rings, is a suitable hydrocarbon, such as alkyl, alkoxy, aryl, derivatives thereof, or mixtures thereof; and a halogen, or mixtures of the hydrocarbon and halogen, and especially those substitutents selected from the group consisting of Cl and $CH_3$; and molecules of the following formula

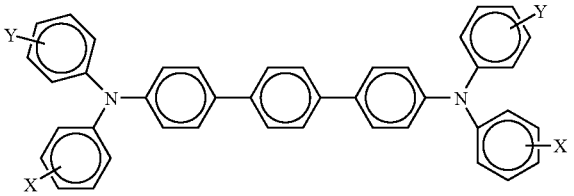

wherein X and Y are independently alkyl, alkoxy, aryl, a halogen, or mixtures thereof.

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments.

Examples of specific aryl amines present in an amount of from about 20 to about 90 weight percent include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substitutent is a chloro substitutent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules can be selected, reference for example, U.S. Pat. Nos. 4,921,773 and 4,464,450, the disclosures of which are totally incorporated herein by reference.

Examples of the binder materials selected for the charge transport layers include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly (4,4'-isopropylidene-diphenylene)carbonate (also referred to as bisphenol-A-polycarbonate), poly(4,4'-cyclohexylidine-diphenylene)carbonate (also referred to as bisphenol-Z-polycarbonate), poly(4,4'-isopropylidene-3,3'-dimethyl-diphenyl)carbonate (also referred to as bisphenol-C-polycarbonate), and the like. In embodiments, electrically inactive binders are comprised of polycarbonate resins with a molecular weight of from about 20,000 to about 100,000, or with a molecular weight Mw of from about 50,000 to about 100,000 preferred. Generally, the transport layer contains from about 10 to about 75 percent by weight of the charge transport material, and more specifically, from about 35 percent to about 50 percent of this material.

The charge transport layer or layers, and more specifically, a first charge transport in contact with the photogenerating layer, and thereover a top or second charge transport overcoating layer may comprise charge transporting small molecules dissolved or molecularly dispersed in a film forming electrically inert polymer such as a polycarbonate. In embodiments, "dissolved" refers, for example, to forming a solution in which the small molecule is dissolved in the polymer to form a homogeneous phase; and "molecularly dispersed in embodiments" refers, for example, to charge transporting molecules dispersed in the polymer, the small molecules being dispersed in the polymer on a molecular scale. Various charge transporting or electrically active small molecules may be selected for the charge transport layer or layers. In embodiments, "charge transport" refers, for example, to charge transporting molecules as a monomer that allows the free charge generated in the photogenerating layer to be transported across the transport layer.

Examples of hole transporting molecules, especially for the first and second charge transport layers, and present in an amount of from about 40 to about 90 weight percent, include, for example, pyrazolines such as 1-phenyl-3-(4'-diethylamino styryl)-5-(4"-diethylamino phenyl)pyrazoline; aryl amines such as N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine; hydrazones such as N-phenyl-N-methyl-3-(9-ethyl)carbazyl hydrazone and 4-diethyl amino benzaldehyde-1,2-diphenyl hydrazone; and oxadiazoles, such as 2,5-bis(4-N,N'-diethylaminophenyl)-1,2,4-oxadiazole, stilbenes, and the like. However, in embodiments, to minimize or avoid cycle-up in equipment, such as printers, with high throughput, the charge transport layer should be substantially free (less than about two percent) of di or triamino-triphenyl methane. A small molecule charge transporting compound that permits injection of holes into the photogenerating layer with high efficiency, and transports them across the charge transport layer with short transmit times includes N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine, or mixtures thereof. If desired, the charge transport material in the charge transport layer may comprise a polymeric charge transport material, or a combination of a small molecule charge transport material and a polymeric charge transport material.

A number of processes may be used to mix, and thereafter apply the charge transport layer or layers chelating coating mixture to the photogenerating layer. Typical application techniques include spraying, dip coating, roll coating, wire wound rod coating, and the like. Drying of the charge transport deposited coating may be effected by any suitable conventional technique such as oven drying, infrared radiation drying, air drying, and the like.

The thickness of each of the charge transport layers in embodiments is from about 10 to about 70 micrometers, but thicknesses outside this range may in embodiments also be selected. The charge transport layer should be an insulator to the extent that an electrostatic charge placed on the hole transport layer is not conducted in the absence of illumination at a rate sufficient to prevent formation and retention of an electrostatic latent image thereon. In general, the ratio of the thickness of the charge transport layer to the photogenerating layer can be from about 2:1 to 200:1, and in some instances 400:1. The charge transport layer is substantially nonabsorbing to visible light or radiation in the region of intended use, but is electrically "active" in that it allows the injection of photogenerated holes from the photoconductive layer, or photogenerating layer, and allows these holes to be transported through itself to selectively discharge a surface charge on the surface of the active layer.

The thickness of the continuous charge transport overcoat layer selected depends upon the abrasiveness of the charging (bias charging roll), cleaning (blade or web), development (brush), transfer (bias transfer roll), and the like in the system employed, and can be up to about 10 microns. In embodiments, this thickness for each layer is from about 1 micron to about 5 microns. Various suitable and conventional methods may be used to mix, and thereafter apply the charge transport layer, and an overcoat layer coating mixture to the photogenerating layer. Typical application techniques include spraying, dip coating, roll coating, wire wound rod coating, and the like. Drying of the deposited coating may be effected by any suitable conventional technique, such as oven drying, infrared radiation drying, air drying, and the like. The dried overcoating layer of this disclosure can in embodiments transport holes during imaging and should not have too high a free carrier concentration. Free carrier concentration in the overcoat increases the dark decay. Examples of overcoatings are illustrated in copending applications U.S. application Ser. No. 11/593,657, filed Nov. 7, 2006, and U.S. application Ser. No. 11/593,662, filed Nov. 7, 2006, the disclosures of which are totally incorporated herein by reference.

The optional hole blocking or undercoat layer for the imaging members of the present disclosure can contain a number of components as illustrated herein, including known hole blocking components, such as amino silanes, doped metal oxides, a metal oxide like titanium, chromium, zinc, tin, and the like; a mixture of phenolic compounds and a phenolic resin, or a mixture of two phenolic resins; and optionally a dopant such as $SiO_2$. The phenolic compounds usually contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene)bisphenol), P (4,4'-(1,4-phenylenediisopropylidene) bisphenol), S (4,4'-sulfonyldiphenol), Z (4,4'-cyclohexylidenebisphenol); hexafluorobisphenol A (4,4'-(hexafluoro isopropylidene) diphenol), resorcinol, hydroxyquinone, catechin, and the like.

The hole blocking layer can be, for example, comprised of from about 20 weight percent to about 80 weight percent, and more specifically, from about 55 weight percent to about 65 weight percent of a suitable component like a metal oxide, such as $TiO_2$, from about 20 weight percent to about 70 weight percent, and more specifically, from about 25 weight percent to about 50 weight percent of a phenolic resin; from about 2 weight percent to about 20 weight percent, and more specifically, from about 5 weight percent to about 15 weight percent of a phenolic compound containing at least two phenolic groups, such as bisphenol S, and from about 2 weight percent to about 15 weight percent, and more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9 nanometers. To the above dispersion, a phenolic compound and dopant are added followed by mixing. The hole blocking layer coating dispersion can be applied by dip coating or web coating, and the layer can be thermally cured after coating. The hole blocking layer resulting is, for example, of a thickness of from about 0.01 micron to about 30 microns, and more specifically, from about 0.1 micron to about 8 microns. Examples of phenolic resins include formaldehyde polymers with phenol, p-tert-butylphenol, cresol, such as VARCUM® 29159 and 29101 (available from OxyChem Company), and DURITE® 97 (available from Borden Chemical), formaldehyde polymers with ammonia, cresol and phenol, such as VARCUM® 29112 (available from OxyChem Company), formaldehyde polymers with 4,4'-(1-methylethylidene) bisphenol, such as VARCUM™ 29108 and 29116 (available from OxyChem Company), formaldehyde polymers with cresol and phenol, such as VARCUM® 29457 (available from OxyChem Company), DURITE® SD-423A, SD-422A (available from Borden Chemical), or formaldehyde polymers with phenol and p-tert-butylphenol, such as DURITE® ESD 556C (available from Borden Chemical). The optional hole blocking layer may be applied to the substrate. Any suitable and conventional blocking layer capable of forming an electronic barrier to holes between the adjacent photoconductive layer (or electrophotographic imaging layer) and the underlying conductive surface of the substrate may be selected.

Hole blocking layer components can comprise an aminosilane, such as 3-aminopropyl triethoxysilane, N,N-dimethyl-3-aminopropyl triethoxysilane, N-phenylaminopropyl trimethoxysilane, triethoxysilylpropylethylene diamine, trimethoxysilylpropylethylene diamine, trimethoxysilylpropyldiethylene triamine, N-aminoethyl-3-aminopropyl trimethoxysilane, N-2-aminoethyl-3-aminopropyl trimethoxysilane, N-2-aminoethyl-3-aminopropyl tris(ethylethoxy) silane, p-aminophenyl trimethoxysilane, N,N'-dimethyl-3-aminopropyl triethoxysilane, 3-aminopropylmethyl diethoxysilane, 3-aminopropyl trimethoxysilane, N-methylaminopropyl triethoxysilane, methyl[2-(3-trimethoxysilylpropylamino)ethylamino]-3-proprionate, (N,N'-dimethyl 3-amino)propyl triethoxysilane, N,N-dimethylaminophenyl triethoxysilane, trimethoxysilyl propyldiethylene triamine, and the like, and mixtures thereof. Specific aminosilane materials are 3-aminopropyl triethoxysilane (γ-APS), N-aminoethyl-3-aminopropyl trimethoxysilane, (N,N'-dimethyl-3-amino)propyl triethoxysilane, and mixtures thereof.

Examples of components or materials optionally incorporated into the charge transport layers or at least one charge transport layer to, for example, enable improved lateral charge migration (LCM) resistance include hindered phenolic antioxidants, such as tetrakis methylene(3,5-di-tert-butyl-4-hydroxy hydrocinnamate) methane (IRGANOX™ 1010, available from Ciba Specialty Chemical), butylated hydroxytoluene (BHT), and other hindered phenolic antioxidants including SUMILIZER™ BHT-R, MDP-S, BBM-S, WX-R, NR, BP-76, BP-101, GA-80, GM and GS (available from Sumitomo Chemical Co., Ltd.), IRGANOX™ 1035, 1076, 1098, 1135, 1141, 1222, 1330, 1425WL, 1520L, 245, 259, 3114, 3790, 5057 and 565 (available from Ciba Specialties Chemicals), and ADEKA™ STAB AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SNKYO CO., Ltd.), TINUVIN™ 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl)phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layers is from about 0 to about 20, from about 1 to about 10, or from about 3 to about 8 weight percent.

Primarily for purposes of brevity, the examples of each of the substitutents and each of the components/compounds/molecules, polymers, (components) for each of the layers, specifically disclosed herein are not intended to be exhaustive. Thus, a number of suitable components, polymers, formulas, structures, and substitutent examples and carbon chain lengths not specifically disclosed or claimed are intended to be encompassed by the present disclosure and claims. For example, these substitutents include suitable known groups, such as aliphatic and aromatic hydrocarbons with various carbon chain lengths, and which hydrocarbons can be substituted with a number of suitable known groups and mixtures thereof. Also, the carbon chain lengths are intended to include all numbers between those disclosed or claimed or envisioned, thus from 1 to about 12 carbon atoms, includes 1, 2, 3, 4, 5, 6, 7, 8, 9, 10, 11, and 12, up to 25, or more. Similarly, the thickness of each of the layers, the examples of components in each of the layers, the amount ranges of each of the components disclosed and claimed is not exhaustive, and it is intended that the present disclosure and claims encompass other suitable parameters not disclosed, or that may be envisioned.

The following Examples are being submitted to illustrate embodiments of the present disclosure. These Examples are intended to be illustrative only, and are not intended to limit the scope of the present disclosure. Also, parts and percentages are by weight unless otherwise indicated. Thicknesses were measured with a permascope.

Comparative Example 1

A photoconductor was prepared by providing a 0.02 micron thick titanium layer coated (the coater device) on a biaxially oriented polyethylene naphthalate substrate (KALEDEX™ 2000) having a thickness of 3.5 mils, and applying thereon, with a gravure applicator, a hole blocking layer solution containing 50 grams of 3-aminopropyl triethoxysilane (γ-APS), 41.2 grams of water, 15 grams of acetic acid, 684.8 grams of denatured alcohol, and 200 grams of heptane. This layer was then dried for about 1 minute at 120° C. in the forced air dryer of the coater. The resulting hole blocking layer had a dry thickness of 500 Angstroms. An adhesive layer was then prepared by applying a wet coating over the blocking layer, using a gravure applicator, and which adhesive contained 0.2 percent by weight based on the total weight of the solution of the copolyester adhesive (ARDEL D100™ available from Toyota Hsutsu Inc.) in a 60:30:10 volume ratio mixture of tetrahydrofuran/monochlorobenzene/methylene chloride. The adhesive layer was then dried for about 1 minute at 120° C. in the forced air dryer of the coater. The resulting adhesive layer had a dry thickness of 200 Angstroms.

A photogenerating layer dispersion was prepared by introducing 0.45 gram of the known polycarbonate IUPILON 200™ (PCZ-200) weight average molecular weight of 20,000, available from Mitsubishi Gas Chemical Corporation, and 50 milliliters of tetrahydrofuran into a 4 ounce glass bottle. To this solution were added 2.4 grams of hydroxygallium phthalocyanine (Type V) and 300 grams of ⅛ inch (3.2 millimeters) diameter stainless steel shot. This mixture was then placed on a ball mill for 8 hours. Subsequently, 2.25 grams of PCZ-200 were dissolved in 46.1 grams of tetrahydrofuran, and added to the hydroxygallium phthalocyanine dispersion. The slurry resulting was then placed on a paint shaker for 10 minutes. The resulting dispersion was, thereafter, applied to the above adhesive interface with a Bird applicator to form a photogenerating layer having a wet thickness of 0.25 mil. A strip about 10 millimeters wide along one edge of the substrate web bearing the blocking layer and the adhesive layer was deliberately left uncoated by any of the photogenerating layer material to facilitate adequate electrical contact by the ground strip layer that was applied later. The photogenerating layer was dried at 120° C. for 1 minute in a forced air oven to form a dry photogenerating layer having a thickness of 0.4 micron.

The resulting imaging member web was then overcoated with a charge transport layer prepared by introducing into an amber glass bottle in a weight ratio of 1:1 N,N'-diphenyl-N,N'-bis(3-methylphenyl)-1,1'-biphenyl-4,4'-diamine, and MAKROLON 5705®, a known polycarbonate resin having a molecular weight average of from about 50,000 to about 100,000, commercially available from Farbenfabriken Bayer A. G. The resulting mixture was then dissolved in methylene chloride to form a solution containing 15 percent by weight solids. This solution was applied onto the photogenerating layer, and where the charge transport layer upon drying (120° C. for 1 minute) had a thickness of 29 microns. During this coating process, the humidity was equal to or less than 15 percent.

Example I

A photoconductor was prepared by repeating the process of Comparative Example 1 except that there was added to the charge transport layer solution about 0.5 weight percent of the chelating agent catechol. Thereafter, the resulting solution was applied to the above photogenerating layer with a Bird applicator to form the charge transport layer, which after drying at 120° C. for 1 minute had a thickness of 29 microns. The ratio in parts of the charge transport compound to polycarbonate to chelating agent was 50/50/0.5.

Example II

A photoconductor was prepared by repeating the process of Comparative Example 1 except that there was added to the charge transport layer solution about 2 weight percent of the chelating agent catechol. Thereafter, the resulting solution was applied to the above photogenerating layer with a Bird applicator to form the charge transport layer, which after drying at 120° C. for 1 minute had a thickness of 29 microns. The ratio in parts of the charge transport compound to polycarbonate to chelating agent was 50/50/2.

Example III

A photoconductor is prepared by repeating the process of Comparative Example 1 except that there is added to the charge transport layer solution about 0.5 weight percent of the chelating agent alizarin. Thereafter, the resulting solution is applied to the above photogenerating layer with a Bird applicator to form the charge transport layer, which after drying at 120° C. for 1 minute had a thickness of 29 microns. The ratio in parts of the charge transport compound to polycarbonate to chelating agent is 50/50/0.5.

Example IV

A photoconductor is prepared by repeating the process of Comparative Example 1 except that there is added to the charge transport layer solution about 0.5 weight percent of the chelating agent dopamine. Thereafter, the resulting solution is applied to the above photogenerating layer with a Bird applicator to form the charge transport layer, which after drying at 120° C. for 1 minute had a thickness of 29 microns. The ratio in parts of the charge transport compound to polycarbonate to chelating agent is 50/50/0.5.

Electrical Property Testing

Three of the above prepared photoconductors (Comparative Example 1, Example I and Example II) were tested in a scanner set to obtain photoinduced discharge cycles, sequenced at one charge-erase cycle, followed by one charge-expose-erase cycle, wherein the light intensity was incrementally increased with cycling to produce a series of photoinduced discharge characteristic (PIDC) curves from which the photosensitivity and surface potentials at various exposure intensities were measured. Additional electrical characteristics were obtained by a series of charge-erase cycles with incrementing surface potential to generate several voltage versus charge density curves. The scanner is equipped with a scorotron set to a constant voltage charging at various surface potentials. The photoconductors were tested at surface potentials of 500 volts with the exposure light intensity incrementally increased by regulating a series of neutral density filters; the exposure light source was a 780 nanometer light emitting diode. The xerographic simulation was completed in an environmentally controlled light tight chamber at ambient conditions (40 percent relative humidity and 22° C.).

Compared with the photoconductor of Comparative Example 1, the photoconductors of Examples I and II exhibited very similar photo-induced discharge curves. Thus, incorporation of the chelating agent into the charge transport layer did not adversely affect the electrical properties of the photoconductors.

Charge Deficient Spots (CDS) Measurement

Various known methods have been developed to assess and/or accommodate the occurrence of charge deficient spots. For example, U.S. Pat. Nos. 5,703,487 and 6,008,653, the disclosures of each patent being totally incorporated herein by reference, disclose processes for ascertaining the microdefect levels of an electrophotographic imaging member. The method of U.S. Pat. No. 5,703,487, the disclosure of which is totally incorporated herein by reference, designated as field-induced dark decay (FIDD), involves measuring either the differential increase in charge over and above the capacitive value, or measuring reduction in voltage below the capacitive value of a known imaging member and of a virgin imaging member, and comparing differential increase in charge over and above the capacitive value or the reduction in voltage below the capacitive value of the known imaging member and of the virgin imaging member or photoconductor.

U.S. Pat. Nos. 6,008,653 and 6,150,824, the disclosures of each patent being totally incorporated herein by reference, disclose a method for detecting surface potential charge patterns in an electrophotographic imaging member or photoconductor with a floating probe scanner. Floating Probe Micro Defect Scanner (FPS) is a contactless process for detecting surface potential charge patterns in an electrophotographic imaging member. The scanner includes a capacitive probe having an outer shield electrode, which maintains the probe adjacent to and spaced from the imaging surface to form a parallel plate capacitor with a gas between the probe and the imaging surface, a probe amplifier optically coupled to the probe, establishing relative movement between the probe and the imaging surface, a floating fixture which maintains a substantially constant distance between the probe and the imaging surface. A constant voltage charge is applied to the imaging surface prior to relative movement of the probe and the imaging surface past each other, and the probe is synchronously biased to within about +/−300 volts of the average surface potential of the imaging surface to prevent breakdown, measuring variations in surface potential with the probe, compensating the surface potential variations for variations in distance between the probe and the imaging surface, and comparing the compensated voltage values to a baseline voltage value to detect charge patterns in the electrophotographic imaging member. This process may be conducted with a contactless scanning system comprising a high resolution capacitive probe, a low spatial resolution electrostatic voltmeter coupled to a bias voltage amplifier, and an imaging member having an imaging surface capacitively coupled to and spaced from the probe and the voltmeter. The probe comprises an inner electrode surrounded by and insulated from a coaxial outer Faraday shield electrode, the inner electrode connected to an opto-coupled amplifier, and the Faraday shield connected to the bias voltage amplifier. A threshold of 20 volts is commonly chosen to count charge deficient spots.

The photoconductors of Comparative Example 1 and Examples I and II were measured for CDS counts using the above-described FPS technique, and the results follow in Table 1.

TABLE 1

| | CDS (counts/cm$^2$) |
|---|---|
| Comparative Example 1 | 29 |
| Example I | 24 |
| Example II | 15 |

The above CDS data demonstrates that the photoconductors containing the chelating agent had a CDS that was suppressed gradually with increasing concentration of the chelating agent, and more specifically, the Example II photoconductor improved in CDS counts by about 50 percent as compared to the Comparative Example 1 control of 29.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor comprising an optional supporting substrate, a photogenerating layer, and at a charge transport layer, and wherein said charge transport layer contains a chelating additive containing at least one of the following phenolic moieties

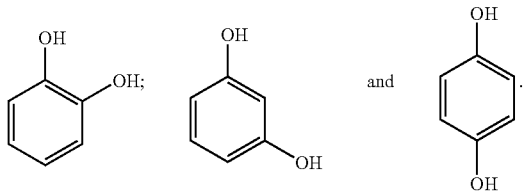

2. A photoconductor in accordance with claim 1 wherein said charge transport layer is prepared from a dispersion of a charge transport compound and said chelating additive.

3. A photoconductor in accordance with claim 1 wherein said charge transport layer is prepared from a dispersion of at least one charge transport compound, a polymer, a solvent, and said chelating additive.

4. A photoconductor in accordance with claim 1 wherein said chelating additive is selected from the group consisting of catechol, 1,3-benzenediol, 1,4-benzenediol, 4-methylcatechol, 3-methylcatechol, 1,2,4-benzenetriol, pyrogallol, 3-fluorocatechol, 3,4-dihydroxybenzonitrile, 2,3-dihydroxybenzaldehyde, 3,4-dihydroxybenzaldehyde, 3-methoxycatechol, 5-methyl-1,2,3-benzenetriol, 2-methoxy-1,4-benzenediol, 4-chloro-1,2-benzenediol, 1-(3,4-dihydroxyphenyl)ethanone, 2,4,5-trihydroxybenzaldehyde, 2,3,4-trihydroxybenzaldehyde, 3,4-dihydroxybenzoic acid, 2,3-dihydroxybenzoic acid, 3,4,5-trihydroxybenzaldehyde, 4-nitro-1,2-benzenediol, 1,2-naphthalenediol, 2,3-naphthalenediol, 4-tert-butyl-1,2-benzenediol, 3-isopropyl-6-methyl-1,2-benzenediol, methyl 3,4-dihydroxybenzoate, (3,4-dihydroxyphenyl)acetic acid, 4,5-dihydroxy-2-methylbenzoic acid, 3,4,5-trihydroxybenzamide, 4-(2-amino-1-hydroxyethyl)-1,2-benzenediol, 2,4,5-trihydroxybenzoic acid, 2,3,4-trihydroxybenzoic acid, 2,6-dimethoxy-1,4-benzenediol, 4-(1,2-dihydroxyethyl)-1,2-benzenediol, 7,8-dihydroxy-2H-chromen-2-one, 6,7-dihydroxy-2H-chromen-2-one, 3,5-dichloro-1,2-benzenediol, 2-methyl-1,3-benzothiazole-5,6-diol, 4-(2-aminoethyl)-1,2-benzenediol hydrochloride, 7,8-dihydroxy-4-methyl-2H-chromen-2-one, 3-tert-butyl-5-methoxy-1,2-benzenediol, 3,5-dinitro-1,2-benzenediol, 2-(3,4,5-trihydroxybenzylidene)malononitrile, 4-[2-(methylamino)ethyl]-1,2-benzenediol hydrochloride, 5-(2-aminoethyl)-1,2,4-benzenetriol hydrochloride, 5-(2-aminoethyl)-1,2,3-benzenetriol hydrochloride, 7,8-dihydroxy-6-methoxy-2H-chromen-2-one, 2,3,4,6-tetrahydroxy-5H-benzo[a]cyclohepten-5-one, 12,10-anthracenetriol, 3,4-dihydroxy-7,8,9,10-tetrahydro-6H-benzo[c]chromen-6-one, 4-{(E)-[(3,5-dimethyl-4H-1,2,4-triazol-4-yl)imino]methyl}-1,2-benzenediol, 4-{[(E)-(2,3-dihydroxyphenyl)methylidene]amino}benzonitrile, 1,2-dihydroxyanthra-9,10-quinone, 4-[(E)-2-(3,5-dihydroxyphenyl)ethenyl]-1,2-benzenediol, 6-[(E)-2-(3,4-dihydroxyphenyl)ethenyl]-4-hydroxy-2H-pyran-2-one, 3,4,5,6-tetrachloro-1,2one, 3,4,5,6-tetrachloro-1,2-benzenediol, 5-(2-aminoethyl)-1,2,4-benzenetriol hydrobromide, 7,8-dihydroxy-2-phenyl-4H-chromen-4-one, 1,2,7-trihydroxyanthra-9,10-quinone, 1,2,4-trihydroxyanthra-9,10-quinone, 2,6,7-trihydroxy-9-methyl-3H-xanthen-3-one, and mixtures thereof.

5. A photoconductor in accordance with claim 1 wherein said chelating additive is present in an amount of from about 0.001 to about 30 weight percent, and said at least one is from 1 to about 2.

6. A photoconductor in accordance with claim 1 wherein said chelating additive is present in an amount of from about 0.1 to about 20 weight percent.

7. A photoconductor in accordance with claim 1 wherein said chelating additive is present in an amount of from about 0.5 to about 5 weight percent.

8. A photoconductor in accordance with claim 1 wherein said charge transport layer is comprised of at least one of aryl amine molecules of the formulas

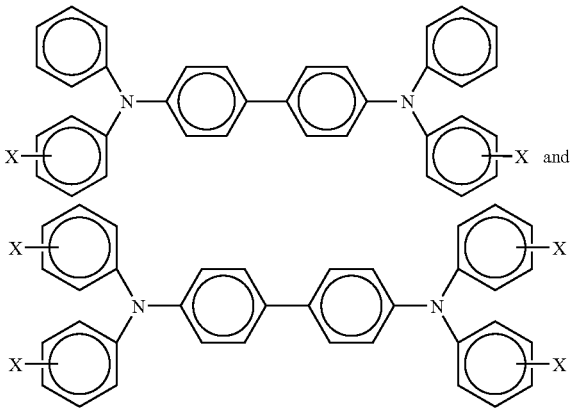

wherein X is selected from the group consisting of at least one of alkyl, alkoxy, aryl, and halogen, and mixtures thereof.

9. A photoconductor in accordance with claim 8 wherein said aryl amine is N,N'-diphenyl-N,N-bis(3-methylphenyl)-1,1'-biphenyl-4,4'-diamine.

10. A photoconductor in accordance with claim 8 wherein said chelating additive is selected from the group consisting of catechol, 1,3-benzenediol, 1,4-benzenediol, 4-methylcatechol, 3-methylcatechol, 1,2,4-benzenetriol, pyrogallol, 3-fluorocatechol, 3,4-dihydroxybenzonitrile, 2,3-dihydroxybenzaldehyde, 3,4-dihydroxybenzaldehyde, 3-methoxycatechol, 5-methyl-1,2,3-benzenetriol, 2-methoxy-1,4-benzenediol, 4-chloro-1,2-benzenediol, 1-(3,4-dihydroxyphenyl)ethanone, 2,4,5-trihydroxybenzaldehyde, 2,3,4-trihydroxybenzaldehyde, 3,4-dihydroxybenzoic acid, 2,3-dihydroxybenzoic acid, 3,4,5-trihydroxybenzaldehyde, 4-nitro-1,2-benzenediol, 1,2-naphthalenediol, 2,3-naphthalenediol, 4-tert-butyl-1,2-benzenediol, 3-isopropyl-6-methyl-1,2-benzenediol, methyl 3,4-dihydroxybenzoate, (3,4-dihydroxyphenyl)acetic acid, 4,5-dihydroxy-2-methylbenzoic acid, 3,4,5-trihydroxybenzamide, 4-(2-amino-1-hydroxyethyl)-1,2-benzenediol, 2,4,5-trihydroxybenzoic acid, 2,3,4-trihydroxybenzoic acid, 2,6-dimethoxy-1,4-benzenediol, 4-(1,2-dihydroxyethyl)-1,2-benzenediol, 7,8-dihydroxy-2H-chromen-2-one, 6,7-dihydroxy-2H-chromen-2-one, 3,5-dichloro-1,2-benzenediol, 2-methyl-1,3-benzothiazole-5,6-diol, 4-(2-aminoethyl)-1,2-benzenediol hydrochloride, 7,8-dihydroxy-4-methyl-2H-chromen-2-one, 3-tert-butyl-5-methoxy-1,2-benzenediol, 3,5-dinitro-1,2-benzenediol, 2-(3,4,5-trihydroxybenzylidene)malononitrile, 4-[2-(methylamino)ethyl]-1,2-benzenediol hydrochloride, 5-(2-aminoethyl)-1,2,4-benzenetriol hydrochloride, 5-(2-aminoethyl)-1,2,3-benzenetriol hydrochloride, 7,8-dihydroxy-6-methoxy-2H-chromen-2-one, 2,3,4,6-tetrahydroxy-5H-benzo[a]cyclohepten-5-one, 1,2,10-anthracenetriol, 3,4-dihydroxy-7,8,9,10-tetrahydro-6H-benzo[c]chromen-6-one, 4-{(E)-[(3,5-dimethyl-4H-1,2,4-triazol-4-yl)imino]methyl}-1,2-benzenediol, 4-{[(E)-(2,3-dihydroxyphenyl)methylidene]amino}benzonitrile, 1,2-dihydroxyanthra-9,10-quinone, 4-[(E)-2-(3,5-dihydroxyphenyl)ethenyl]-1,2-benzenediol, 6-[(E)-2-(3,4-dihydroxyphenyl)ethenyl]-4-hydroxy-2H-pyran-2-one, 3,4,5,6-tetrachloro-1,2one, 3,4,5,6-tetrachloro-1,2-benzenediol, 5-(2-aminoethyl)-1,2,4-benzenetriol hydrobromide, 7,8-dihydroxy-2-phenyl-4H-chromen-4-one, 1,2,7-trihydroxyanthra-9,10-quinone, 1,2,4-trihydroxyanthra-9,10-quinone, and 2,6,7-trihydroxy-9-methyl-3H-xanthen-3-one.

11. A photoconductor in accordance with claim 8 wherein said charge transport layer is comprised of

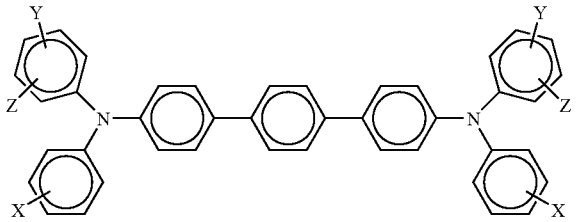

wherein X, Y and Z are alkyl, alkoxy, aryl, substituted derivatives thereof, halogen, and mixtures thereof.

12. A photoconductor in accordance with claim 1 wherein said charge transport layer is comprised of said chelating additive and at least one of

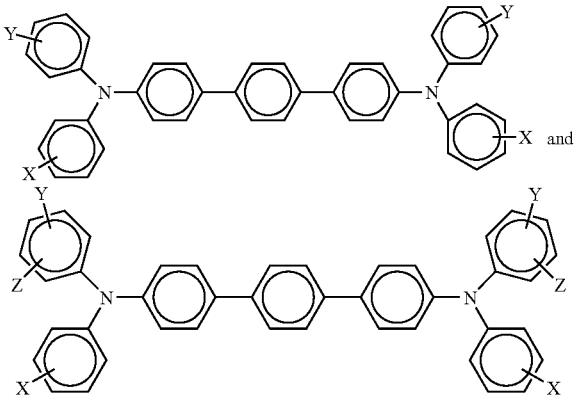

wherein each X and Y is independently selected from the group consisting of alkyl, alkoxy, aryl, halogen; and mixtures thereof; and wherein X, Y and Z are alkyl, alkoxy, aryl, substituted derivatives thereof, halogen, and mixtures thereof.

13. A photoconductor in accordance with claim 12 wherein each alkoxy and alkyl contains from about 1 to about 10 carbon atoms; aryl contains from 6 to about 36 carbon atoms; and halogen is chloride, bromide, fluoride, or iodide, and said at least one is one.

14. A photoconductor in accordance with claim 1 wherein said charge transport layer is comprised of said chelating additive and at least one of N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine, and mixtures thereof.

15. A photoconductor in accordance with claim 1 wherein said charge transport layer contains an antioxidant comprised of at least one of a hindered phenol and a hindered amine.

16. A photoconductor in accordance with claim 1 wherein said charge transport layer is from 1 to about 7 layers, and wherein said chelating additive is selected in an amount of from about 0.5 to about 4 weight percent, and which additive is included in each of 1 to about said 7 layers.

17. A photoconductor in accordance with claim 1 wherein said charge transport layer is from 1 to about 3 layers, and wherein said chelating additive is present in an amount of from about 0.5 to about 4 weight percent.

18. A photoconductor in accordance with claim 1 wherein said charge transport layer is comprised of said chelating additive and a top charge transport layer and a bottom charge transport layer, wherein said bottom layer is situated between said photogenerating layer and said top layer, and wherein said bottom layer contains said chelating additive.

19. A photoconductor in accordance with claim 1 wherein said photogenerating layer comprises a photogenerating pigment comprised of at least one of a hydroxygallium phthalocyanine, a titanyl phthalocyanine, a halogallium phthalocyanine, an alkoxygallium phthalocyanine, a perylene, and mixtures thereof.

20. A photoconductor in accordance with claim 1 wherein said photogenerating pigment is comprised of a hydroxygallium phthalocyanine, said substrate is present, and said at least one is one.

21. A photoconductor in accordance with claim 1 wherein said chelating additive is present in an amount of from about 0.01 to about 5 weight percent.

22. A photoconductor in accordance with claim 1 wherein said chelating additive is at least one of catechol, alizarin, and dopamine present in an amount of from 0.5 to about 5 weight percent.

23. A photoconductor in accordance with claim 1 wherein said chelating additive is selected from the group consisting of catechol, 1,3-benzenediol, 1,2-naphthalenediol, 2,3-naphthalenediol, alizarin, and dopamine, and wherein said chelating additive is present in an amount of from about 0.5 to about 5 weight percent.

24. A photoconductor in accordance with claim 1 wherein said chelating additive is comprised of three phenolic groups, and where the phenolic groups are present on one benzene ring, and wherein the weight average molecular weight of said additive is from about 100 to about 1,500.

25. A photoconductor in accordance with claim 1 wherein said chelating additive is selected from the group consisting of catechol, 1,3-benzenediol, 1,2-naphthalenediol, 2,3-naphthalenediol, alizarin, and dopamine.

26. A photoconductor in accordance with claim 1 wherein said chelating additive is alizarin.

27. A photoconductor in accordance with claim 1 wherein said chelating additive is catechol.

28. A photoconductor in accordance with claim 1 wherein said chelating additive is catechol present in an amount of from about 0.2 to about 5 weight percent.

29. A flexible photoconductor comprising in sequence a supporting substrate layer, a photogenerating layer, and a chelating additive containing charge transport layer wherein said additive is selected from the group consisting of catechol, 1,3-benzenediol, 1,4-benzenediol, 4-methylcatechol, 3-methylcatechol, 1,2,4-benzenetriol, pyrogallol, 3-fluorocatechol, 3,4-dihydroxybenzonitrile, 2,3-dihydroxybenzaldehyde, 3,4-dihydroxybenzaldehyde, 3-methoxycatechol, 5-methyl-1,2,3-benzenetriol, 2-methoxy-1,4-benzenediol, 4-chloro-1,2-benzenediol, 1-(3,4-dihydroxyphenyl)ethanone, 2,4,5-trihydroxybenzaldehyde, 2,3,4-trihydroxybenzaldehyde, 3,4-dihydroxybenzoic acid, 2,3-dihydroxybenzoic acid, 3,4,5-trihydroxybenzaldehyde, 4-nitro-1,2-benzenediol, 1,2-naphthalenediol, 2,3-naphthalenediol, 4-tert-butyl-1,2-benzenediol, 3-isopropyl-6-methyl-1,2-benzenediol, methyl 3,4-dihydroxybenzoate, (3,4-dihydroxyphenyl)acetic acid, 4,5-dihydroxy-2-methylbenzoic acid, 3,4,5-trihydroxybenzamide, 4-(2-amino-1-hydroxyethyl)-1,2-benzenediol, 2,4,5-trihydroxybenzoic acid, 2,3,4-trihydroxybenzoic acid, 2,6-dimethoxy-1,4-benzenediol, 4-(1,2-dihydroxyethyl)-1,2-benzenediol, 7,8-dihydroxy-2H-chromen-2-one, 6,7-dihydroxy-2H-chromen-2-one, 3,5-dichloro-1,2-benzenediol, 2-methyl-1,3-benzothiazole-5,6-diol, 4-(2-aminoethyl)-1,2-benzenediol hydrochloride, 7,8-dihydroxy-4-methyl-2H-chromen-2-one, 3-tert-butyl-5-methoxy-1,2-benzenediol, 3,5-dinitro-1,2-benzenediol, 2-(3,4,5-trihydroxybenzylidene)malononitrile, 4-[2-(methylamino)ethyl]-1,2-benzenediol hydrochloride, 5-(2-aminoethyl)-1,2,4-benzenetriol hydrochloride, 5-(2-benzenetriol hydrochloride, 5-(2-aminoethyl)-1,2,3-benzenetriol hydrochloride, 7,8-dihydroxy-6-methoxy-2H-chromen-2-one, 2,3,4,6-tetrahydroxy-5H-benzo[a]cyclohepten-5-one, 1,2,10-anthracenetriol, 3,4-dihydroxy-7,8,9,10-tetrahydro-6H-benzo[c]chromen-6-one, 4-{(E)-[(3,5-dimethyl-4H-1,2,4-triazol-4-yl)imino]methyl}-1,2-benzenediol, 4-{[(E)-(2,3-dihydroxyphenyl)methylidene]amino}benzonitrile, 1,2-dihydroxyanthra-9,10-quinone, 4-[(E)-2-(3,5-dihydroxyphenyl)ethenyl]-1,2-benzenediol, 6-[(E)-2-(3,4-dihydroxyphenyl)ethenyl]-4-hydroxy-2H-pyran-2-one, 3,4,5,6-tetrachloro-1,2-benzenediol, 5-(2-aminoethyl)-1,2,4-benzenetriol hydrobromide, 7,8-dihydroxy-2-phenyl-4H-chromen-4-one, 1,2,7-trihydroxyanthra-9,10-quinone, 1,2,4-trihydroxyanthra-9,10-quinone, and 2,6,7-trihydroxy-9-methyl-3H-xanthen-3-one.

* * * * *